US008660455B2

(12) United States Patent
Sato

(10) Patent No.: US 8,660,455 B2
(45) Date of Patent: Feb. 25, 2014

(54) IMAGE FORMATION APPARATUS

(75) Inventor: Haruo Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 401 days.

(21) Appl. No.: 13/075,692

(22) Filed: Mar. 30, 2011

(65) Prior Publication Data

US 2011/0249982 A1 Oct. 13, 2011

(30) Foreign Application Priority Data

Apr. 9, 2010 (JP) ..... 2010-090253

(51) Int. Cl.
*G03G 21/20* (2006.01)

(52) U.S. Cl.
USPC ..... 399/92; 399/107

(58) Field of Classification Search
USPC ..... 399/92, 107
See application file for complete search history.

(56) References Cited

U.S. PATENT DOCUMENTS 5,528,345 A * 6/1996 Hasegawa ..... 399/122
7,715,747 B2 * 5/2010 Kitozaki ..... 399/92

FOREIGN PATENT DOCUMENTS

JP 11-065404 A 3/1999
JP 2001005354 A * 1/2001
JP 2001-183959 A 7/2001
JP 2004-013063 A 1/2004
JP 2004-325762 A 11/2004
JP 2007-211622 A 8/2007

OTHER PUBLICATIONS

English Translation—JP 2001005354 A, Nanba, Jan. 2001.*

* cited by examiner

*Primary Examiner* — Ryan Walsh
(74) *Attorney, Agent, or Firm* — Marvin A. Motsenbocker; Mots Law, PLLC

(57) ABSTRACT

An image formation apparatus includes: an image formation unit configured to form a developer image; an image transfer unit configured to transfer the developer image from the image formation unit to a recording medium; a fixation unit having a heater to fix the developer image to the recording medium; a duct provided between the image formation unit and the fixation unit, the duct comprising a first circumference section made of heat conductive material and a second circumference section made of heat insulation material; and a fan to flow air through the duct.

19 Claims, 9 Drawing Sheets

IMAGE FORMATION APPARATUS

CROSS REFERENCE TO RELATED APPLICATIONS

This application claims priority based on 35 USC 119 from prior Japanese Patent Application No. 2010-090253 filed on Apr. 9, 2010, entitled "IMAGE FORMATION APPARATUS", the entire contents of which are incorporated herein by reference.

BACKGROUND OF THE INVENTION

1. Field of the Invention

The invention relates to an image formation apparatus having a heating fixation unit.

2. Description of Related Art

In a conventional image formation apparatus, there has been known a technique to downsize the apparatus by disposing an image formation section closer to a heating fixation unit provided downstream of the image formation section.

Japanese Patent Application Laid-Open No. 2004-325762 discloses a technique to prevent excessive increase of the internal temperature of an image formation apparatus by controlling heating of a fixation unit based on the temperature of a conveyance belt.

SUMMARY OF THE INVENTION

However, even in the conventional image formation apparatus, image quality may deteriorate.

An object of an aspect of the invention is to reduce deterioration of the image quality.

An aspect of the invention is an image formation apparatus including: an image formation unit configured to form a developer image; an image transfer unit configured to transfer the developer image from the image formation unit to a recording medium; a fixation unit having a heater to fix the developer image to the recording medium; a duct provided between the image formation unit and the fixation unit, the duct comprising a first circumference section made of heat conductive material and a second circumference section made of heat insulation material; and a fan configured to flow air through the duct.

According to the aspect of the invention, deterioration of the image quality in the image formation apparatus is reduced.

DETAILED DESCRIPTION OF THE EMBODIMENTS

Figure 1:
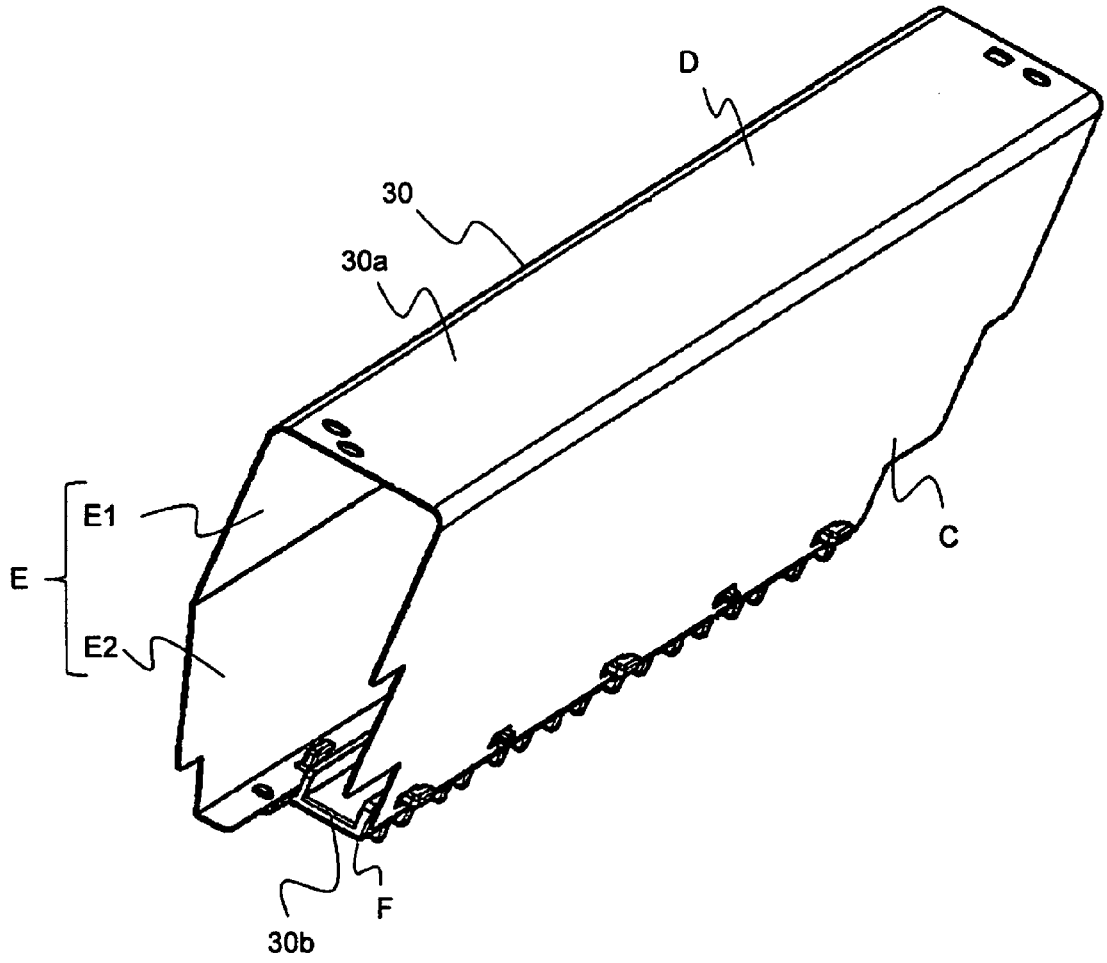
FIG. 1 is a perspective view of a duct according to a first embodiment of the invention.

Descriptions are provided herein below for embodiments based on the drawings. In the respective drawings referenced herein, the same constituents are designated by the same reference numerals and duplicate explanation concerning the same constituents is omitted. All of the drawings are provided to illustrate the respective examples only.

In a conventional image formation apparatus, if the amount of heat transfer from a fixation unit to an image formation section is excessively large, toner in the image formation section may be fused and the toner image formed by the image formation section may deteriorate, causing a defect and/or a low density portion in the image formed by the image formation apparatus, that is, causing deterioration of the image quality. This becomes much more pronounced, as the distance between the fixation unit and the image formation section is reduced resulting from downsizing of the image formation apparatus.

To solve this problem, the embodiments of the invention provide a duct between the fixation unit and the image formation section and provide air flow through the duct, to prevent fusion of toner in the image formation section.

[First Embodiment]

[Configuration of First Embodiment]

Figure 3:
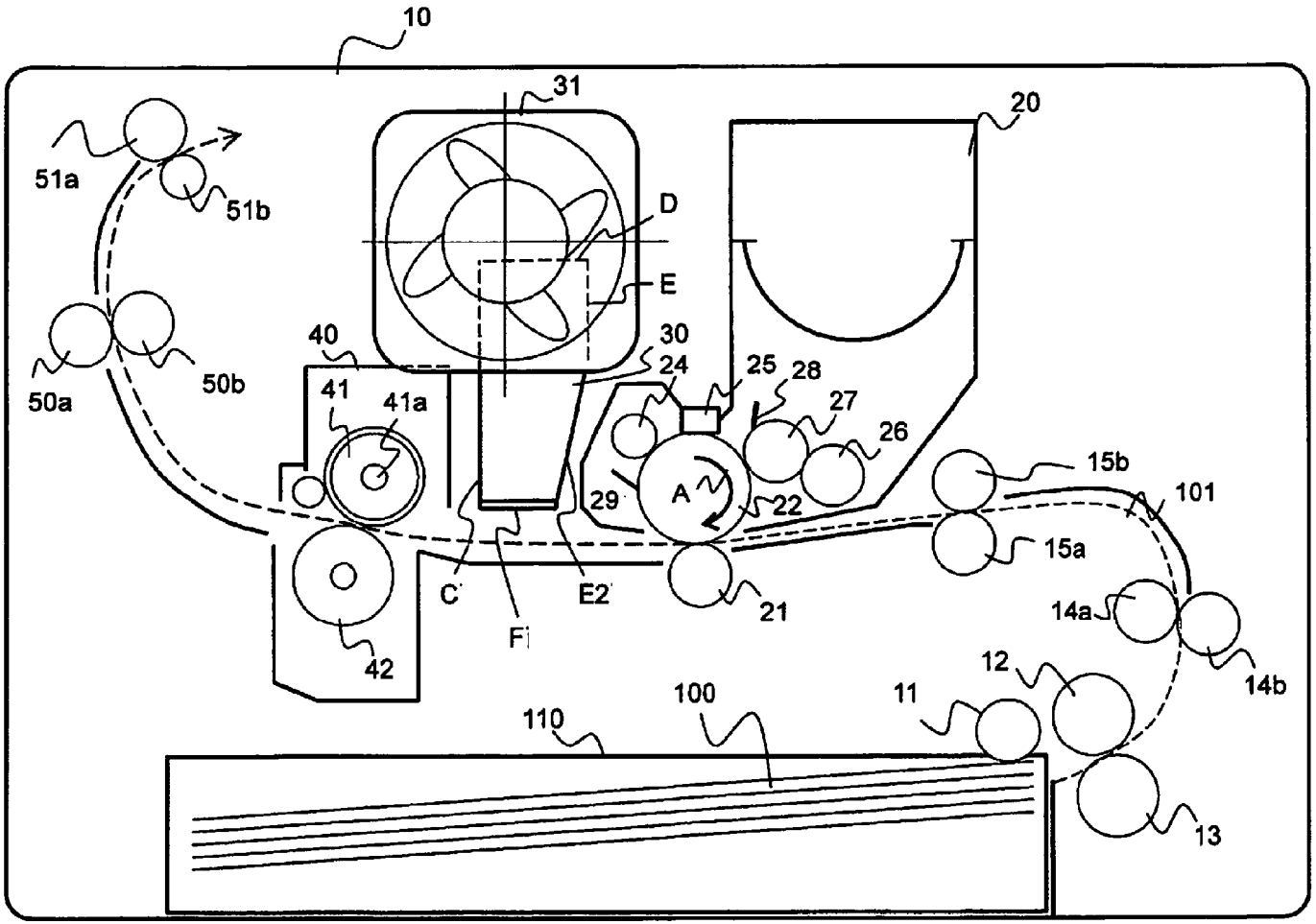
FIG. 3 is a transparent view of an image formation apparatus according to the first embodiment of the invention, as seen from the left side.

FIG. 3 is a transparent view of an image formation apparatus of the first embodiment, as seen from the left side.

Image formation apparatus 10 includes: sheet cassette 110 attached to the lower portion of image formation apparatus 10 to store therein recording media (for example, recording sheets 100); a feed mechanism which sequentially feeds recording sheets 100; conveyance rollers 14*a* and 14*b* which convey recording sheets 100; resist rollers 15*a* and 15*b*; an image formation section which forms a toner image on recording sheet 100; fixation unit 40 which fixes the toner image to recording sheet 100; a discharge mechanism which discharges recording sheet 100; and a stacker (not shown) in which discharged recording sheets 100 are stacked.

Sheet cassette 110 is a cassette in which plural recording sheets 100 can be stored and is detachably attached to the lower portion of image formation apparatus 10. Recording sheet 100 is of predetermined size on which monochrome or color images can be recorded and may be paper such as a high quality paper, a recycled paper, a glossy paper, or a mat paper, a film for an overhead projector, or the like.

The feed mechanism includes pickup roller 11, feed roller 12, and retard roller 13. Pickup roller 11 rotates while being in press contact with recording sheets 100. Feed roller 12 and retard roller 13 are provided downstream of pickup roller 11 in conveyance path 101 such that these rollers 12 and 13 are opposed to each other with conveyance path 101 therebetween.

Conveyance rollers 14*a* and 14*b* are provided downstream of the feed mechanism in conveyance path 101 such that conveyance rollers 14*a* and 14*b* are opposed to each other with conveyance path 101 therebetween. Conveyance roller 14*a* is driven by an unillustrated conveyance motor.

Resist rollers 15*a* and 15*b* are provided downstream of conveyance rollers 14*a* and 14*b* in conveyance path 101 such that resist rollers 15*a* and 15*b* are opposed to each other with conveyance path 101 therebetween. Resist roller 15*a* is driven by an unillustrated resist motor.

The image formation section includes image formation unit 20 and image transfer roller 21 as an image transfer unit. Image formation unit 20 includes: photosensitive drum 22 or an image carrier to be charged and carry an electrostatic latent image; charge roller 24 or a charge device which charges photosensitive drum 22; exposure device 25 which emits light according to image information to the surface of photosensitive drum 22 to form the electrostatic latent image on the surface of photosensitive drum 22; supply roller 26 or a supply device which supplies toner or developer to development roller 27 serving as a developer carrier; development roller 27 which develops the electrostatic latent image formed on the surface of photosensitive drum 22 by supplying toner thereon to the latent image; toner regulation member 28 or a layer regulation member which forms a toner layer of a constant thickness on development roller 27 by metering the toner on development roller 27; and cleaning device 29 which removes toner remaining on the surface of photosensitive drum 22. Image formation unit 20 functions as a development means to develop the developer image (for example, the toner image) on photosensitive drum 22.

Photosensitive drum 22 is formed with a conductive base layer made of aluminum or the like and a photosensitive layer on the conductive base layer formed of a charge generation layer and a charge transport layer. Photosensitive drum 22 has a cylindrical tubular shape and is rotatably supported. Photosensitive drum 22 is disposed in contact with charge roller 24, image transfer roller 21, development roller 27, and a tip of cleaning device 29. Photosensitive drum 22 is configured to retain electrical charge on the surface thereof and carry, on the charged surface thereof, the electrostatic latent image and the toner image (or the developer image) which is developed by supplying the toner or the developer to the electrostatic latent image. That is, photosensitive drum 22 functions as the image carrier. Photosensitive drum 22 rotates in the direction of arrow A. Next, the configuration of image formation unit 20 will be described in the order of the rotational direction of photosensitive drum 22.

Charge roller 24 is formed by coating a conductive metal shaft with a semi-conductive rubber such as silicon. Charge roller 24 has a cylindrical tubular shape and is rotatbably supported in press contact with photosensitive drum 22. Charge roller 24 is charged by an unillustrated power supply and is driven to rotate in press contact with photosensitive drum 22, so that charge roller 24 applies a predetermined voltage to photosensitive drum 22 to have the surface of photosensitive drum 22 retain the electric charge uniformly.

Exposure device 25 is provided above photosensitive drum 22 and includes plural light-emitting diode (referred to as "LED") elements, a lens array, and LED drive elements. Exposure device 25 forms an electrostatic latent image on the surface of photosensitive drum 22 by emitting light according to image information onto the surface of photosensitive drum 22.

Supply roller 26 is formed by coating a conductive metal shaft with rubber and has a cylindrical tubular shape. Supply roller 26 is disposed in contact with development roller 27. Supply roller 26 is charged by an unillustrated power supply while being in press contact with development roller 27, so that supply roller 26 supplies toner to development roller 27.

Development roller 27 has a cylindrical tubular shape and is formed by coating a conductive metal shaft with a semi-conductive urethane rubber or the like. Development roller 27 is disposed in contact with supply roller 26, photosensitive drum 22, and the tip of toner regulation member 28. Development roller 27 is charged by an unillustrated power supply while being in press contact with supply roller 26, so that development roller 27 is supplied with the toner.

Toner regulation member 28 is made of stainless steel or the like and has a plate shape. Toner regulation member 28 is disposed such that the tip of toner regulation member 28 is in contact with the surface of development roller 27. Toner regulation member 28 thus meters the toner on the surface of development roller 27 thereby regulating the toner layer on the surface of development roller 27 to an uniform thickness.

Cleaning device 29 is made of rubber or the like and has a plate shape. Cleaning device 29 is disposed with its tip being in contact with the surface of photosensitive drum 22. Cleaning device 29 cleans the surface of photosensitive drum 22 by removing toner remaining on the surface of photosensitive drum 22 after image transfer of the toner image from photosensitive drum 22 to recording sheet 100.

Heating fixation unit 40, serving as a fixation device or a fixation unit, includes heat roller 41 or a fixation member and backup roller 42 or a press member. Heat roller 41 includes a cylindrical tubular core and a heat-resisting elastic layer made of silicone rubber or the like and formed on the outer circumferential surface of the core. In the cylindrical tubular core, halogen lamp 41*a* or a heater is supported by an illustrated support body at either end of the core. Both ends of the core are supported by an unillustrated rotatable support member. Heat roller 41 is heated to a high temperature by halogen lamp 41*a* provided inside thereof.

Backup roller 42 is a core of a solid shaft and a heat-resisting elastic layer made of silicone rubber or the like and formed on an outer circumferential surface of the core. The core of backup roller 42 is rotatably supported by an unillustrated rotatable support member, like heat roller 41, and is biased against heat roller 41 by an unillustrated bias member such as a spring or the like. Note that, the unillustrated rotatable support member to rotatably support backup roller 41 is supported while being movable only in directions toward and away heat roller 41. A nip area is defined between backup roller 42 and heat roller 41 with the bias force therebetween.

The discharge mechanism includes discharge rollers 50*a* and 50*b* and discharge rollers 51*a* and 51*b*. Discharge rollers 50*a* and 50*b* and discharge rollers 51*a* and 51*b* are disposed downstream of heating fixation unit 40 in conveyance path 101 such that they are opposed to each other with conveyance path 101 therebetween and are driven by an illustrated discharge motor.

Duct 30 is disposed between image formation unit 20 and heating fixation unit 40. Duct 30 functions to remove heat generated by heating fixation unit 40. Air exhaust fan 31 is disposed facing an end of duct 30 that is the near side of duct 30 in FIG. 3. Air exhaust fan 31 discharges heated air from insides of duct 30 and the apparatus so as to discharge heat from insides of duct 30 and the apparatus. Duct 30 is formed with side D (an upper side of duct 30), side E1 (an upper portion of a lateral side of duct 30 (right side in FIG. 3)), side E2 (a lower portion of the lateral side (right side in FIG. 3)), side C (the other lateral side of duct 30 (left side in FIG. 3)), and side F (a lower side of duct 30.

FIG. 1 is a perspective view of duct 30 shown in FIG. 3 according to the first embodiment of the invention. Duct 30 has an opening end at each longitudinal end and has a substantially rectangle shape in cross section. Duct 30 is hollow and air flows between the open ends thereof. Duct 30 includes plate 30*a* as a first circumference section or a first duct member and guide 30*b* as a second circumference section or a second duct member. Plate 30*a* comprises the upper side (side D), the lateral sides (sides E and C), and a part of the lower side of duct 30 (side F). Plate 30*a* is formed of a carbon steel plate or a steel plate as a heat conductive material. The steel plate has a thickness of 0.3 mm to 0.5 mm, because a steel plate having a thickness of more than 0.5 mm transfers heat more easily so as to heat image formation unit 20 more easily and because a steel plate having a thickness of less than 0.3 mm has insufficient stiffness properties. The lateral sides of duct 30 are side C and side E, the upper side of duct 30 is side D, and the lower side of duct 30 is side F.

Figure 5:
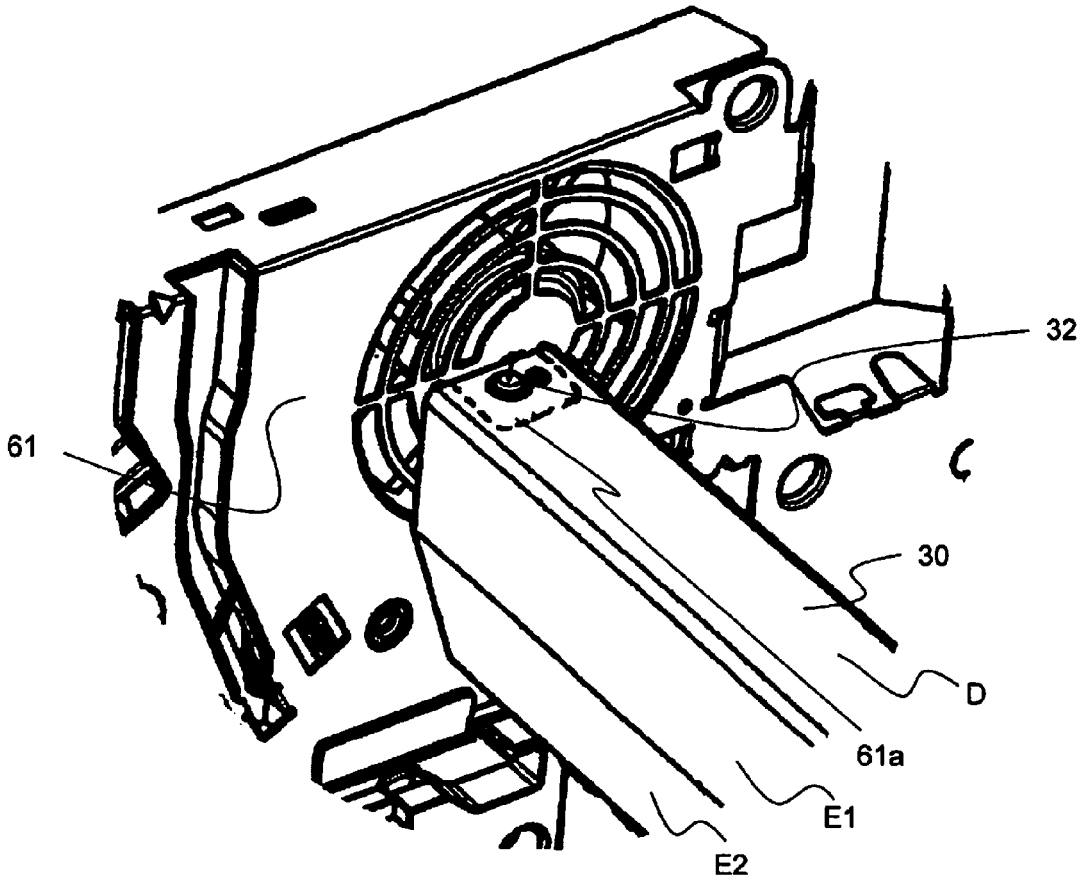
FIG. 5 is a view illustrating the attachment of the duct of FIG. 1 to a left side plate.
Figure 6:
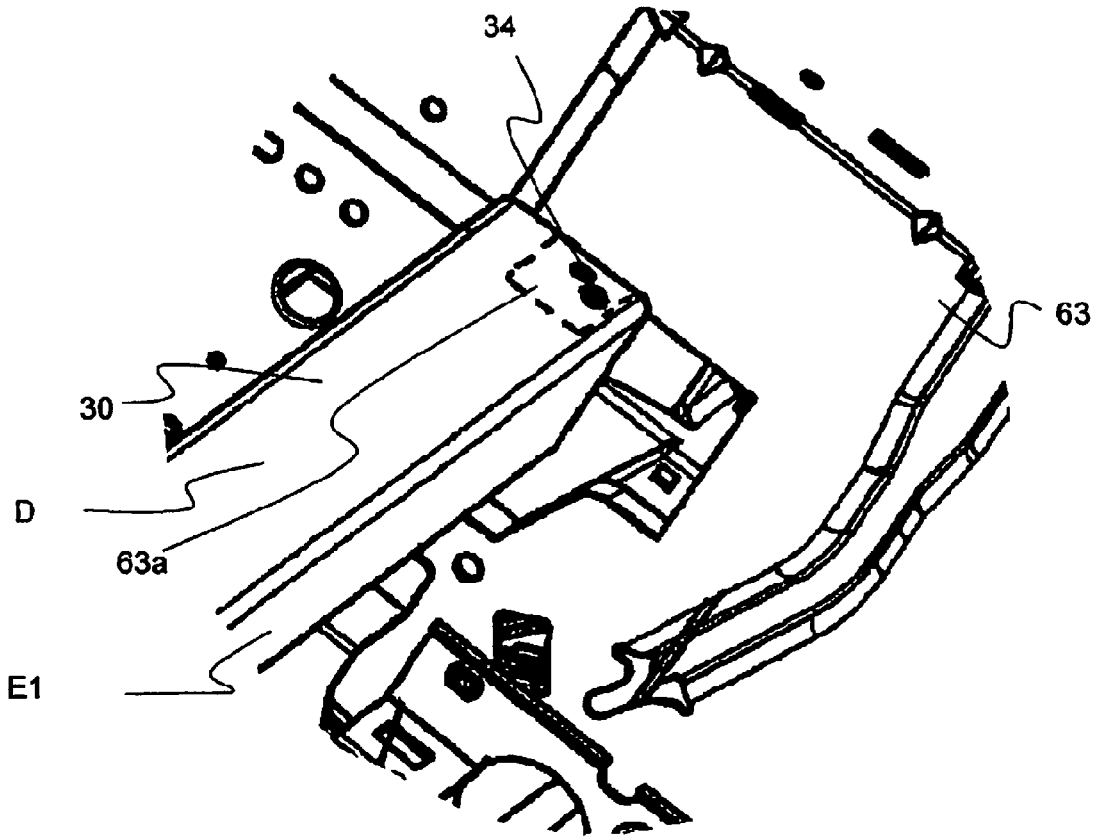
FIG. 6 is a view illustrating the attachment of the duct of FIG. 1 to a right side plate.

Face D is formed with mounting holes for screw 32 (see FIG. 5) and screw 34 (see FIG. 6). Face E consists of side E1 which is a portion of side E higher than an obtuse bend in side E and side E2 which is a portion lower than the obtuse bend in side E. Face E1 is orthogonal to side D, and side E2 is inclined toward side C (in lateral width direction) such that the lateral width of duct 30 decrease as it becomes closer to the lower side as shown in FIGS. 1 and 3. Since the lateral width of duct 30 decreases beneath the obtuse bend of side E, a paper jam that might occurred right after image formation unit 20 is easily viewable and also the distance between image formation unit 20 and heating fixation unit 40 can be smaller, resulting in downsize of image formation apparatus 10. Furthermore, the obtuse bend of side E strengthens the stiffness of duct 30.

Guide 30*b* constitutes a part of the lower side of duct 30. Guide 30*b* is made of polycarbonate or plastic resin as a heat insulation material. Thus, heat received by side C of duct 30 rarely transfers through guide 30*b* but mostly transfers via side D to side E. Guide 30*b* functions as a heat insulation portion of duct 30.

Figure 2:
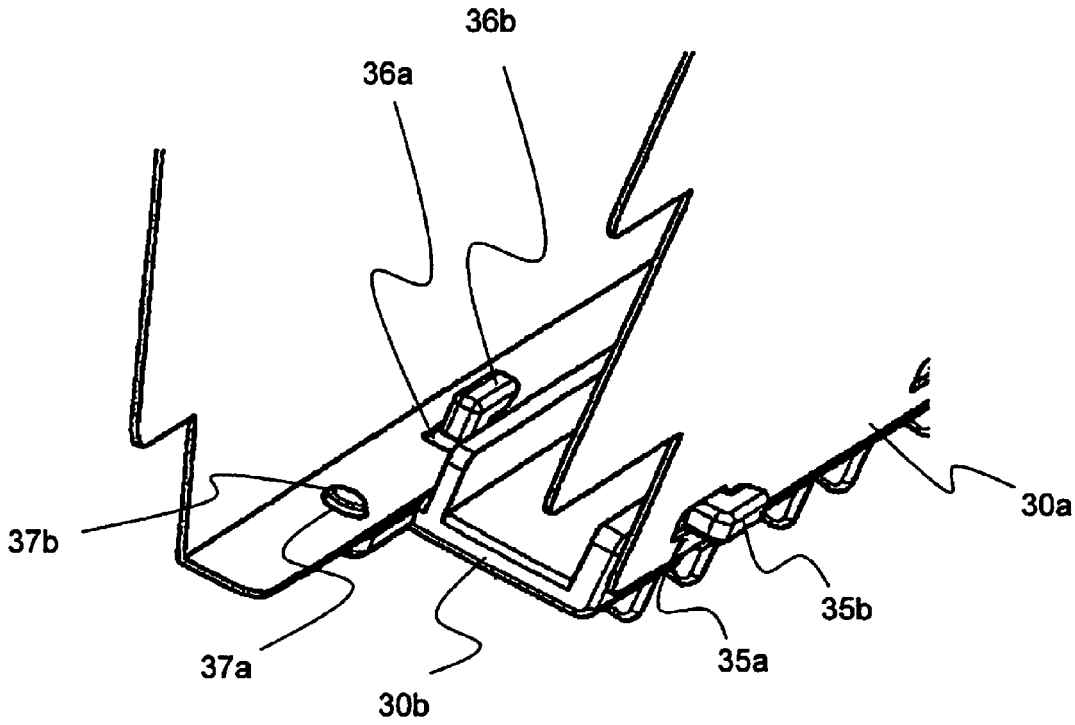
FIG. 2 is a partial enlarged view of the duct of FIG. 1.

FIG. 2 is a partial enlarged view of duct 30 shown in FIG. 1. A lower end portion of side C has hole 35*a* serving as an engagement part or an engagement hole, on which hook 35*b* of guide 30*b* serving as an engagement part or an engagement projection is hooked, so that plate 30*a* and guide 30*b* latches together with such engagement means.

The lower side of plate 30*a*, which is a part of the lower side of duct 30, has hole 36*a* serving as an engagement part or an engagement hole, on which hook 36*b* of guide 30*b* serving as an engagement part or an engagement projection is hooked, so that the lower side of plate 30*a* and guide 30*b* latch together. The lower side of plate 30*a* also has hole 37*a*, into which jut 37*b* of guide 30*b* fits, so that the lower side of plate 30*a* and guide 30*b* latch together. Plate 30*a* and guide 30*b* are separated bodies and are merely loosely-latched to each other using hooks 35*b*, 36*b*, and 37*b*, without being strongly attached to each other using screws, adhesive, or the like. In other words, the contact area between connection between plate 30*a* and guide 30*b* with the loose-latch according to the embodiment is smaller than in the case of strong attachment using screws, adhesive, or the like. Thus, the heat that is received by side C of duct 30 is rarely transferred to guide 30*b*. Note that although plate 30*a* has hole 35*a* and guide 30*b* has hook 35*b* in this embodiment, a configuration in which plate 30*a* has a hook and guide 30*b* has a hole may be used.

Figure 4:
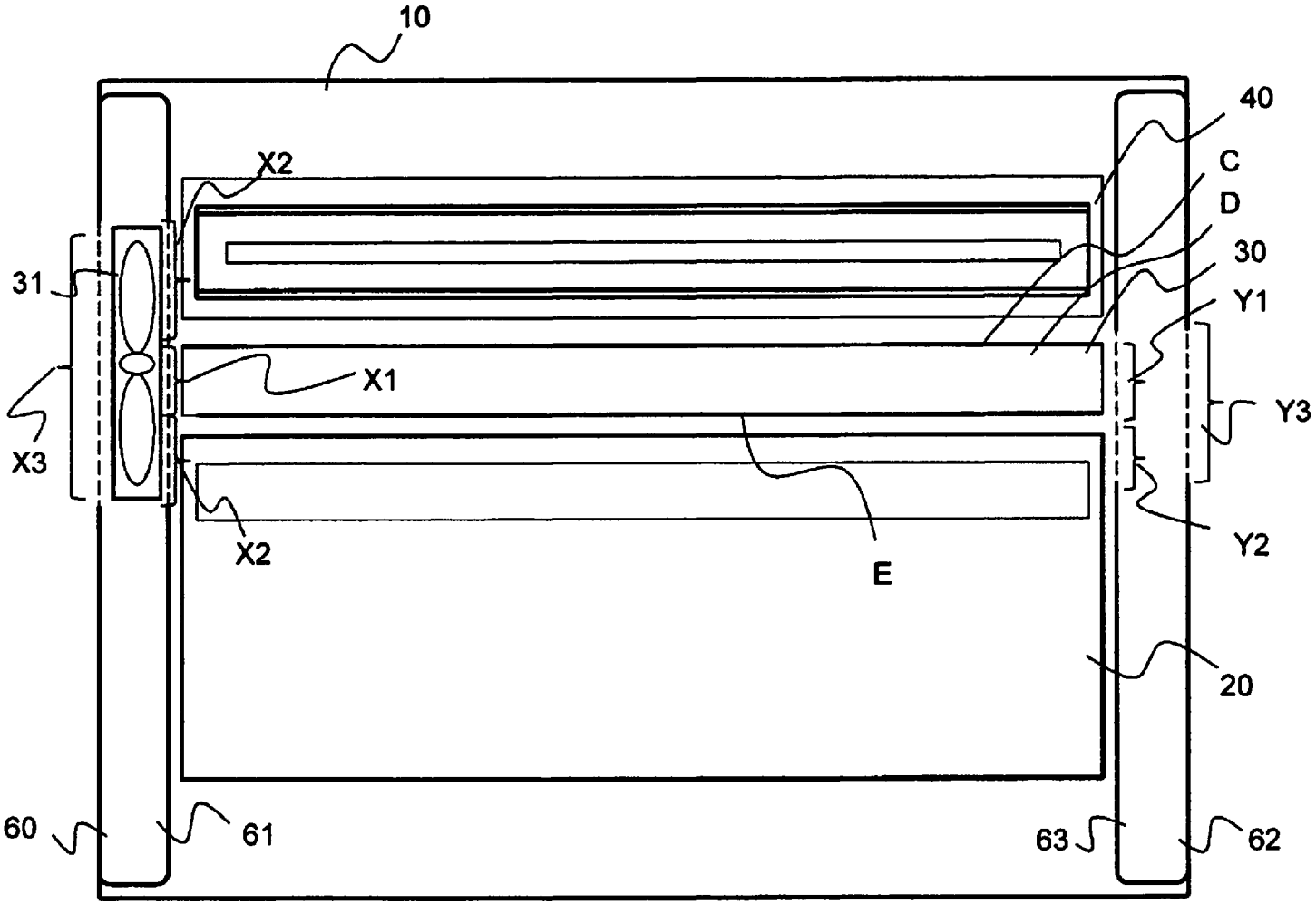
FIG. 4 is a transparent view of the image formation apparatus of FIG. 3 as seen from the upper side.

FIG. 4 is a transparent view of the image formation apparatus of the first embodiment, as seen from the upper side.

Image formation apparatus 10 has left side cover 60 and left sideplate 61 at its left side and right side cover 62 and right side plate 63 at its right side. Each side cover 60 and 62 constitutes a part of the housing of the image formation apparatus. Left side plate 61 directly or indirectly supports left ends of components of the printer engine (for example, the image formation section (20, 21), the rollers, and fixation unit 40) and duct 30. Right side plate 63 directly or indirectly supports right ends of components of the printer engine (for example, the image formation section (20, 21), the rollers, and fixation unit 40) and duct 30. Air exhaust fan 31 is disposed between left side cover 60 and left side plate 61 and functions to discharge air from inside image formation apparatus 10 to outside image formation apparatus 10. For discharging air by air exhaust fan 31, left side cover 60 is formed with ventilation holes X3 and left side plate 61 is formed with ventilation holes X1 and X2. Likewise, right side cover 62 is formed with ventilation holes Y3 and right sideplate 63 is formed with ventilation holes Y1 and Y2.

Duct 30 is disposed between image formation unit 20 and heating fixation unit 40. Duct 30 has a tubular structure having open ends at its longitudinal ends (left and right ends of duct 30 in FIG. 4). The left end of duct 30 faces ventilation hole X1 and air exhaust fan 31, and the right end of duct 30 faces ventilation hole Y1. The lateral side of duct 30 that is close to image formation unit 20 is side E, the upper side of duct 30 is side D, the lateral side of duct 30 that is close to heating fixation unit 40 is side C.

When air exhaust fan 31 is operated, air is discharged through ventilation holes X3, causing air to flow leftward (in FIG. 4) through ventilation holes X1 and X2, duct 30, and ventilation holes Y1 and Y3. Since image formation apparatus 10 is sealed except for ventilation holes X1 to X3 and Y1 to Y3, air flows leftward (in FIG. 4) through ventilation holes Y2.

FIG. 5 illustrates the attachment of the duct shown in FIG. 1 to the left side plate. The left end of duct 30 is fixed to bent part 61*a* of left side plate 61 with screw 32. Bent part 61*a* is bent at the vicinity of the center of ventilation holes X1 and X2 for air exhaust fan 31 provided in left side plate 61 such that bent part 61*a* protrudes from left side plate 61 in a direction orthogonal to the plane of left side plate 61. Bent part 61*a* is substantially rectangular and has a threaded hole at its center portion, on which screw 32 is threadably mounted.

Duct 30 is tubular and has a substantially rectangular shape in cross section. Duct 30 has a hole at the upper side (side D) near the left end of duct 30. Screw 32 is inserted through the hole of duct 30 and threadably mounted on the threaded hole of bent part 61*a*, so that duct 30 is fixed to left side plate 61. Shown in FIG. 5 are: duct 30, side D as the upper side; side E1 as the upper portion of a lateral side (side E); and side E2 as the lower portion of the lateral side (side E), which is obtusely bent from the upper portion of the lateral side (side E).

FIG. 6 illustrates the attachment of the duct shown in FIG. 1 to the right side plate. The right end of duct 30 is fixed to bent part 63*a* of right side plate 63 with screw 34. Like bent part 61*a*, bent part 63*a* is substantially rectangular and has a threaded hole at its center portion, on which screw 34 is threadably mounted. Bent part 63*a* is bent from a portion of right side plate 63 that is above ventilation hole Y, such that right side plate 63 protrudes from right side plate 63.

Like the left end of duct 30, duct 30 has a hole at the upper side (side D) near the right end of duct 30. Screw 34 is inserted through the hole and screwed to the threaded hole of bent part 63*a*, so that duct 30 is fixed to right side plate 63. Shown in FIG. 6 are: duct 3, side D as the upper side; and side E1 as the upper portion of the lateral side (side E).

Figure 7:
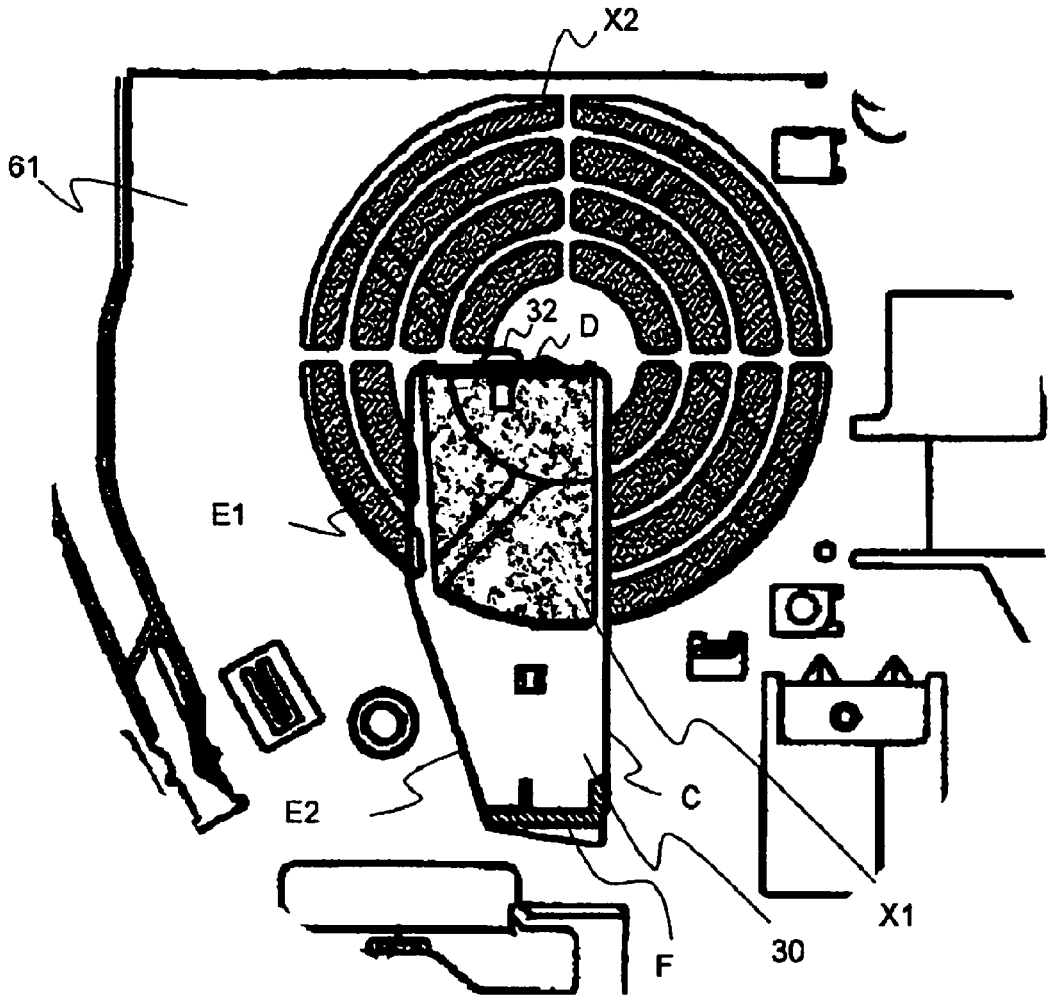
FIG. 7 is a view illustrating the duct of FIG. 1 and ventilation holes X1 and X2.

FIG. 7 is a view illustrating the relationship between the duct of FIG. 1 and ventilation holes X1 and X2. Note that the duct is illustrated being cross-sectioned in FIG. 7. Left side plate 61 has: ventilation hole X1 provided facing the opening end of duct 30 and the rotation area of air exhaust fan 31; and arc ventilation holes X2 provided outside of the opening end of duct 30 and facing the rotation area of air exhaust fan 31.

Ventilation hole X1 functions to discharge air that is inside of duct 30, whereas plural ventilation holes X2 function to discharge air that is outside of duct 30 in the apparatus.

Shown in FIG. 7 are: duct 30, side D as the upper side; side E1 as the upper portion of a lateral side (left side in FIG. 7); side E2 as the lower portion of the lateral side (left side in FIG. 7); side C as the other lateral side (right side in FIG. 7); and side F as the lower side.

Figure 8:
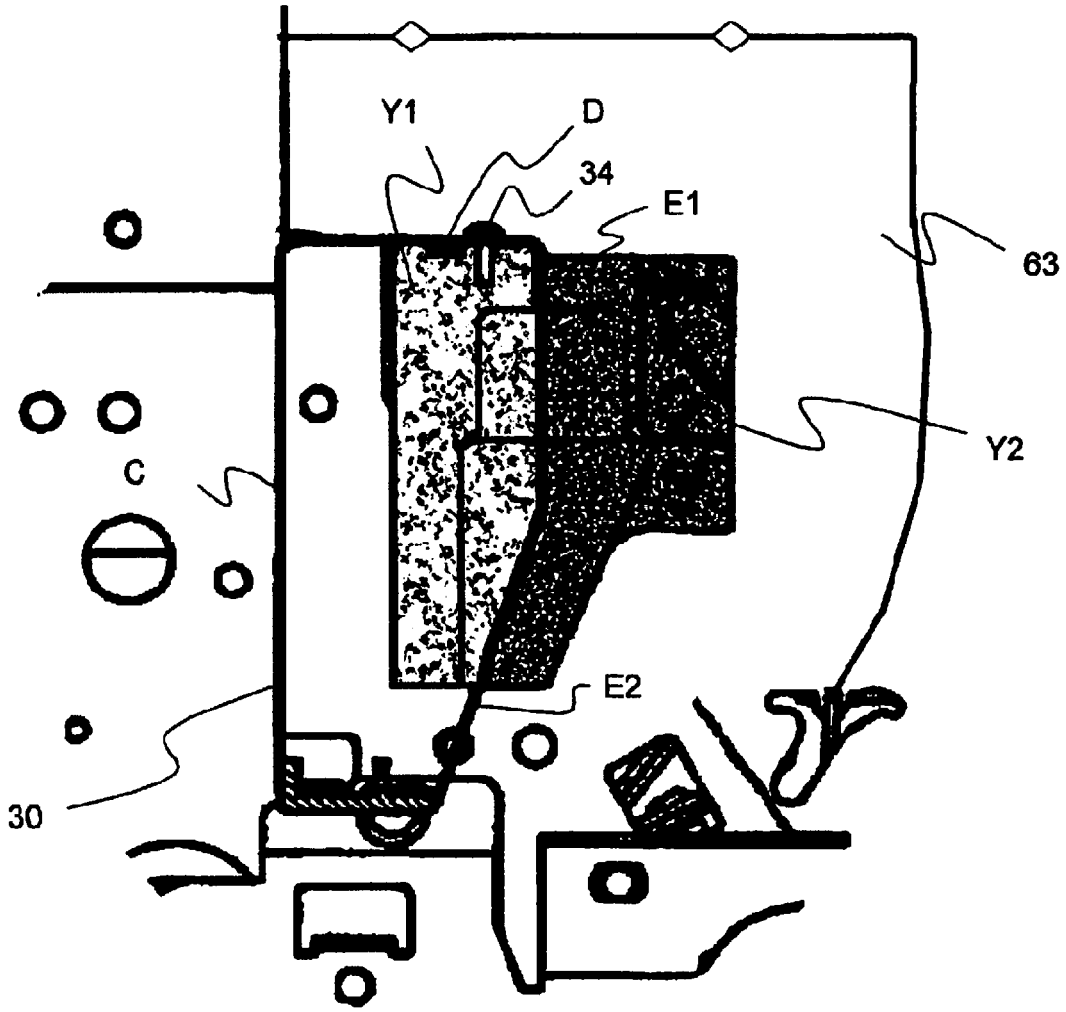
FIG. 8 is a view illustrating the duct of FIG. 1 and ventilation holes Y1 and Y2.

FIG. 8 is a view illustrating the relationship between the duct of FIG. 1 and ventilation holes Y1 and Y2. Note that the duct is illustrated being cross-sectioned in FIG. 8. Right side plate 63 has ventilation hole Y1 facing the opening end of duct 30 and ventilation hole Y2 facing an area other than the opening end of duct 30. Ventilation holes Y1 are for intake of air into duct 30, ventilation hole Y2 is for intake of air into a space that is outside of duct 30 and inside of the apparatus. Shown in FIG. 8 are: duct 30, side D as the upper side; side E1 as the upper portion of one of the lateral sides (right side in FIG. 8); side E2 as the lower portion of the lateral side (right side in FIG. 8); side C as the other lateral side (left side in FIG. 8); and side F as the lower side.

(Operation of First Embodiment)

Print operation of the image formation apparatus will be described with reference to FIG. 3.

Recording sheets 100 are to be conveyed from upstream to downstream in conveyance path 101. Sheet cassette 110 is provided at the upstream end and the stacker is provided at the downstream end of conveyance path 101.

When an unillustrated pickup motor in the feed mechanism rotates pickup roller 11, pickup roller 11 separates recording sheets 100 and sequentially conveys recording sheets 100 to downstream in conveyance path 101.

When an unillustrated feed motor rotates feed roller 12, retard roller 13, which is in contact with feed roller 12, rotates together with feed roller 12. Thus, feed roller 12 and retard roller 13 sandwich therebetween and convey recording sheet 100 that was conveyed from pickup roller 11 to conveyance rollers 14*a* and 14*b*, which are provided downstream of feed roller 12 and retard roller 13 in conveyance path 101.

When an unillustrated conveyance motor rotates conveyance roller 14*a*, conveyance roller 14*b*, which is in contact with conveyance rollers 14*a*, rotates together with conveyance rollers 14*a*. Thus, conveyance rollers 14*a* and 14*b* convey recording sheet 100 to resist rollers 15*a* and 15*b*, which are provided downstream of conveyance rollers 14*a* and 14*b* in conveyance path 101.

When the unillustrated resist motor rotates resist roller 15*a*, resist roller 15*b*, which is in contact with resist roller 15*a*, rotates together with resist roller 15*a*. Thus, resist rollers 15*a* and 15*b* convey recording sheet 100 to the image formation section, which is provided downstream of resist rollers 15*a* and 15*b* in conveyance path 101.

Photosensitive drum 22 in the image formation section rotates in the direction of arrow A while the surface of photosensitive drum 22 is charged uniformly by charge roller 24. Exposure device 25 emits light according to the image information received from an external apparatus such as a host computer or the like onto the uniformly charged surface of photosensitive drum 22 so as to form an electrostatic latent image on the surface of photosensitive drum 22. Supply roller 26 and development roller 27 develop the electrostatic latent image on photosensitive drum 22 with toner thereby forming a toner image on photosensitive drum 22. Photosensitive drum 22 retaining the toner image thereon and image transfer roller 21 rotate together to convey recording sheet 100 while sandwiching recording sheet 100 therebetween, thereby transferring the toner image from photosensitive drum 22 to the upper surface of recording sheet 100. Recording sheet 100 having the transferred toner image thereon is conveyed to heating fixation unit 40 to fix the toner image onto recording sheet 100 in heating fixation unit 40. Cleaning device 29 removes toner remaining on photosensitive drum 22 for the next image forming process.

Recording sheet 100 having the transferred toner image thereon that reaches heating fixation unit 40 is conveyed by heat roller 41 and backup roller 42 in fixation unit 40 while being sandwiched in the nip defined between heat roller 41 and backup roller 42. Recording sheet 100 in the nip is heated by the heat of heat roller 41 and pressed by the bias force of backup roller 42, and thus the toner image on recording sheet 100 is fused and fixed on recording sheet 100.

Recording sheet 100 having the fixed toner image is conveyed by the rotation of discharge rollers 50*a* and 50*b* and discharged to the unillustrated stacker by the rotation of discharge rollers 51*a* and 51*b*.

Heat release by means of duct 30 will be described with reference to FIGS. 1 to FIG. 4. Heating fixation unit 40 is heated to a high temperature by halogen lamp 41*a* provided in heat roller 41. Side C of plate 30*a* is heated to a high temperature by heat radiation of heating fixation unit 40. In contrast, since guide 30*b* has little area that faces heating fixation unit 40, guide 30*b* is barely heated by heat radiation of heating fixation unit 40.

Plate 30*a* is formed of a thin steel plate having a thickness of 0.3 mm to 0.5 mm. Plate 30*a* has a U-shape in cross section and is thus formed with side D as the upper side of duct 30 and sides C and E as the lateral sides of duct 30 with a lower opening. Guide 30*b*, being a part of the lower side of duct 30, is latched to U-shaped plate 30*a* and covers the lower opening of plate 30*a*, thereby forming duct 30. Since guide 30*b* being side F is loosely latched to plate 30*a*, little heat is transferred from side C of plate 30*a* to side F of guide 30*b*. Further, since guide 30*b* being side F of duct 30 is made of heat insulation material, much less heat is transferred from side C to side F.

Thus, transfer conveyance path 101 facing side F and recording sheets 100 in conveyance path 101 facing side F receive little heat radiation from heating fixation unit 40. This prevents toner on recording sheet 100 from being fused before recording sheet 100 reaches fixation unit 40.

Further, heat that has been transferred from side C of plate 30*a* to side F of guide 30*b* is not transferred to side E of plate 30*a*. That is, most of the heat of side C is transferred through side D to side E which is located close to image formation unit 20. Here, the rotation of air exhaust fan 31 introduces cool air outside of image formation apparatus 10 to inside of image formation apparatus 10 through ventilation holes Y3 of right side cover 62 and ventilation holes Y1 and Y2 of right side plate 63. The introduced cool air cools plate 30*a* and is then discharged from inside to outside of image formation apparatus 10 through ventilation holes X1 and X2 of left side plate 61 and ventilation holes X3 of left side cover 60.

Since the heat transfer path from side C through side D to side E of duct 30 is long, in the course of the heat transfer from side C through side D to side E, the heat is collected by the air flow caused by air exhaust fan 31. This reduces the transfer of heat from heating fixation unit 40 to the image formation unit 20, thereby suppressing temperature rise of image formation unit 20.

Note that, if the plate thickness of plate 30*a* is more than 0.5 mm, side C accumulates radiated heat from heating fixation unit 40 much more and the thermal conductance of plate 30*a* is improved, thereby raising the temperature of side D and side E, which raises the temperature of image formation unit 20. That is, sufficient cooling effect cannot be obtained. If the plate thickness of plate 30*a* is less than 0.3 mm, the stiffness of duct 30 may not be adequate. Therefore, preferably, the thickness of plate 30*a* is equal to or greater than 0.3 mm and equal to or less than 0.5 mm.

(Effect of First Embodiment)

Image formation apparatus 10 of the first embodiment has the following effects (A) to (C).

(A): The heat emitted from heating fixation unit 90 is discharged using duct 30 and air exhaust fan 31. This suppresses the temperature rise of image formation unit 20 and thus prevents fusion of the toner in image formation unit 20.

(B): When the heat from heating fixation unit 40 is exhausted using duct 30 and air exhaust fan 31, heat radiation from duct 30 to conveyance path 101 or recording sheet 100 conveyed in conveyance path 101 hardly occurs, since side F of duct 30 which faces conveyance path 101 is made of heat insulation material. This prevents fusion of toner on recording sheet 100 before recording sheet 100 reaches heating fixation unit 40.

(C): Since one side (side F) of duct 30 that faces to conveyance path 101 is made of heat insulation material and the other three sides (sides C, D, and F) of duct 30 are made of heat-conductive material, the heat transfer path is long. This improves the heat release performance when the heat emitted from heating fixation unit 40 is released using duct 30 and air exhaust fun 31, and thus prevents the toner in image formation unit 20 from being fused.

[Second Embodiment]

(Configuration of Second Embodiment)

Figure 9:
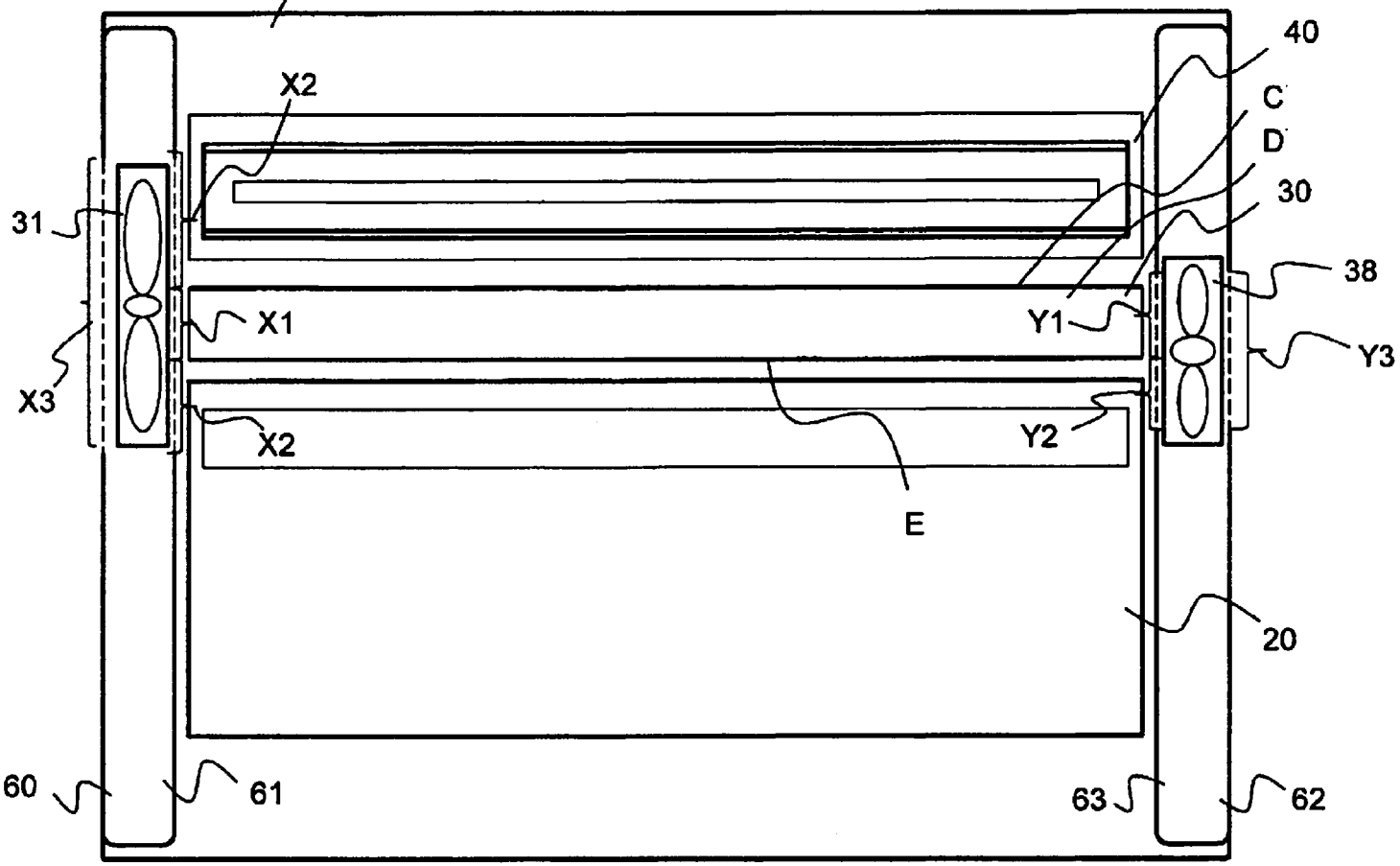
FIG. 9 is a transparent view of an image formation apparatus according to a second embodiment of the invention, as seen from the upper side.

FIG. 9 is a transparent view of an image formation apparatus according to a second embodiment of the invention, as seen from the upper side. In FIG. 9, the same reference numerals are applied to the components that are the same as in FIG. 4 of the first embodiment.

In addition to the components of image formation apparatus 10 of the first embodiment, image formation apparatus 10A of the second embodiment includes air intake fan 38 between right side cover 62 and right side plate 63 to introduce outside air into duct 30.

(Operation of Second Embodiment)

Since the second embodiment has air intake fan 38 at the intake passage in addition to the components of image formation apparatus 10 of the first embodiment, the second embodiment draws much more air than the first embodiment from outside of the image formation apparatus 10A to inside of duct 30 and inside of the image formation apparatus 10A through ventilation holes Y3 of right side cover 62 and ventilation holes Y1 and Y2 of right side plate 63.

In FIG. 9, the radiation heat of heating fixation unit 40 is blocked by plate 30*a* of duct 30. Plate 30*a* whose side C is to be heated by the radiation heat is formed of a thin plate having a thickness of equal to or less than 0.5 mm and is cut off at its lower side. Thus, the heat received by side C is transferred through side D to side E which is provided close to image formation unit 20. In the course of the heat transfer, the faces of plate 30*a* is cooled more than the first embodiment, since the second embodiment takes in the cool outside air to inside duct 30 and inside the apparatus through ventilation holes Y1 and Y2 of right side plate 63 more than the first embodiment, by means of air intake fan 38 and air exhaust fan 31. The heated air is discharged to outside of the apparatus through ventilation holes X1 and X2 of left side plate 61 and ventilation holes X3 of left side cover 60.

(Effect of Second Embodiment)

Image formation apparatus 10A of the second embodiment has the following effect (D) in addition to described effects (A) to (C) of the first embodiment.

(D): Since the second embodiment has air intake fan 38 added, the second embodiment increases the amount of the cool air that is introduced from outside of the apparatus and cools duct 30 and inside of the apparatus. The air is discharged to outside of the apparatus by air exhaust fan 31. This further suppresses the temperature rise of image formation unit 20 and thus prevents fusion of the toner in image formation unit 20.

(Modification)

The invention is not limited to the embodiments described above and various applications and modifications can be made. The following (a) to (c) are examples of the applications and modifications.

(a): While in the first and second embodiments, a case where the invention is applied to a printer is described, the invention may be applied to other image formation apparatuses such as a MFP (multifunction printer/product/peripheral), facsimiles, copying machines, or the like to achieve the same effect.

(b): Although plate 30*a* of duct 30 is formed of carbon steel plate as a heat conductive material in the first and second embodiments, plate 30*a* of duct 30 may be made of a heat conductive material selected from an alloy steel plate, a nickel chrome steel plate, a nickel chrome molybdenum steel, a chrome steel plate, chrome molybdenum steel plate, a manganese steel plate, and a stainless steel plate.

(c): Although guide 30*b* of duct 30 is made of polycarbonate as heat insulation plastic resin in the first and second embodiments, guide 30*b* may be made of another heat insulation material selected from polyamide, polyacetal, polycarbonate, ABS (acrylonitrile butadiene styrene) polycarbonate, modified polyphenylene ether, polybutylene terephthalate, glass fiber-reinforced polybutylene terephthalate, and cyclic polyolefin.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. An image formation apparatus comprising:

an image formation unit configured to form a developer image;

an image transfer unit configured to transfer the developer image from the image formation unit to a recording medium;

a fixation unit having a heater to fix the developer image to the recording medium;

a duct provided between the image formation unit and the fixation unit, the duct comprising a first circumference section made of heat conductive material and a second circumference section made of heat insulation material; and a fan configured to flow air through the duct, wherein the duct includes a first side facing the image formation unit, a second side facing the fixation unit, a third side connecting one end of the first side and one end of the second side, and a fourth side connecting the other end of the first side and the other end of the second side and being shorter than the third side, and the fourth side comprises the second circumference section.

2. The image formation apparatus according to claim 1, wherein the first circumference section and the second circumference section are engaged with each other with engagement parts.

3. The image formation apparatus according to claim 1, wherein the heat insulation material is resin.

4. The image formation apparatus according to claim 3, wherein the resin is made of the heat insulation material selected from polyamide, polyacetal, polycarbonate, ABS (acrylonitrile butadiene styrene) polycarbonate, modified polyphenylene ether, polybutylene terephthalate, glass-fiber-reinforced polybutylene terephthalate, and cyclic polyolefin.

5. The image formation apparatus according to claim 1, wherein the second circumference section is disposed facing a conveyance path in which a recording medium is conveyed.

6. The image formation apparatus according to claim 1, wherein the fan is provided facing an end of the duct.

7. The image formation apparatus according to claim 6, wherein the fan is an air exhaust fan configured to discharge air from inside of the duct to outside of the duct.

8. The image formation apparatus according to claim 7, further comprising:

an air intake fan provided at the other end of the duct and configured to introduce air from outside of the duct to inside of the duct.

9. The image formation apparatus according to claim 1, wherein the duct has an opening at either end thereof and a part of the opening that is not overlapped to the fan and a ventilation hole is closed.

10. An image formation apparatus comprising:

an image formation unit configured to form a developer image;

an image transfer unit configured to transfer the developer image from the image formation unit to a recording medium;

a fixation unit having a heater to fix the developer image to the recording medium;

a duct provided between the image formation unit and the fixation unit, the duct comprising a first circumference section made of heat conductive material and a second circumference section made of heat insulation material; and a fan configured to flow air through the duct, wherein the first circumference section and the second circumference section are engaged with each other with engagement parts, and wherein the engagement parts include a first engagement part formed at one of the first circumference section and the second circumference section and a second engagement part formed at the other of the first circumference section and the second circumference section and being engaged with the first engagement part.

11. The image formation apparatus according to claim 10, wherein the first engagement part is an engagement hole and the second engagement part is an engagement projection to be engaged with the engagement hole.

12. The image formation apparatus according to claim 11, wherein the engagement hole is formed at the first circumference section and the engagement projection is formed at the second circumference section.

13. An image formation apparatus comprising:

an image formation unit configured to form a developer image;

an image transfer unit configured to transfer the developer image from the image formation unit to a recording medium;

a fixation unit having a heater to fix the developer image to the recording medium;

a duct provided between the image formation unit and the fixation unit, the duct comprising a first circumference section made of heat conductive material and a second circumference section made of heat insulation material; and a fan configured to flow air through the duct, wherein the heat conductive material is a metal plate having a thickness of 0.3 to 0.5 mm.

14. The image formation apparatus according to claim 13, wherein the metal plate is made of the heat conductive material selected from a carbon steel plate, an alloy steel plate, a nickel chrome steel plate, a nickel chrome molybdenum steel, a chrome steel plate, chrome molybdenum steel plate, a manganese steel plate, and a stainless steel plate.

15. An image formation apparatus comprising:

an image formation unit configured to form a developer image;

an image transfer unit configured to transfer the developer image from the image formation unit to a recording medium;

a fixation unit having a heater to fix the developer image to the recording medium;

a duct provided between the image formation unit and the fixation unit, the duct comprising a first circumference section made of heat conductive material and a second circumference section made of heat insulation material;

a fan configured to flow air through the duct; and a side plate provided at and supporting each end of the duct and formed with a ventilation hole, wherein the duct has an opening at each end thereof, and a part of the opening end is closed by the side plate and the rest of the opening end is opened facing the ventilation hole of the side plate.

16. An image formation apparatus, comprising:

an image formation unit configured to form a developer image;

an image transfer unit configured to transfer the developer image from the image formation unit to a recording medium;

a fixation unit configured to fix the developer image to the recording medium;

a duct provided between the image formation unit and the fixation unit, the duct comprising a first circumference section and a second circumference section, wherein the first circumference section and the second circumference section are engaged to each other with engagement parts; and a fan configured to flow air through the duct, wherein the engagement parts include a first engagement part formed at one of the first circumference section and the second circumference section and a second engagement part formed at the other of the first circumference section and the second circumference section and being engaged with the first engagement part.

17. The image formation apparatus according to claim 16, wherein the first engagement part is an engagement hole and the second engagement part is an engagement projection to be engaged with the engagement hole.

18. The image formation apparatus according to claim 17, wherein the engagement hole is formed at the first circumference section and the engagement projection is formed at the second circumference section.

19. An image formation apparatus comprising:

an image formation unit configured to form a developer image;

an image transfer unit configured to transfer the developer image from the image formation unit to a recording medium;

a fixation unit having a heater to fix the developer image to the recording medium; and a duct provided between the image formation unit and the fixation unit; and wherein the duct includes a first face facing the image formation unit, a second face facing the fixation unit, a connection face between the first face and the second face, and the first face and the second face are made of heat conductive material, and the connection face is made of heat insulation material.

* * * * *